United States Patent [19]

Takeuchi et al.

[11] Patent Number: 4,711,795

[45] Date of Patent: Dec. 8, 1987

[54] METHOD OF MANUFACTURING AN AMORPHOUS-METAL-COATED STRUCTURE

[75] Inventors: Yukihisa Takeuchi, Aicha; Makoto Takagi, Okazaki, both of Japan

[73] Assignee: Nippondenso Co., Ltd., Kariya, Japan

[21] Appl. No.: 910,269

[22] Filed: Sep. 19, 1986

Related U.S. Application Data

[63] Continuation of Ser. No. 711,486, Mar. 13, 1985, abandoned.

[30] Foreign Application Priority Data

Mar. 14, 1984 [JP] Japan ..... 59-49975

[51] Int. Cl.[4] ..... B05D 5/12

[52] U.S. Cl. ..... 427/130; 427/127; 427/131; 427/132; 427/180; 427/349

[58] Field of Search ..... 427/127–132, 427/180, 349

[56] References Cited

U.S. PATENT DOCUMENTS 3,861,206 1/1975 Kawafune et al. ..... 73/141 R 4,414,855 11/1983 Iwasaki ..... 73/862.36

FOREIGN PATENT DOCUMENTS 59-7433 1/1984 Japan .

*Primary Examiner*—Bernard D. Pianalto

*Attorney, Agent, or Firm*—Cushman, Darby & Cushman

[57] ABSTRACT

A method of manufacturing an amorphous-metal-coated structure having a base material and an amorphous metal coating layer which coats the base material includes a step of applying a high energy rate forming treatment to both the base material and an amorphous metal disposed on the surface of the base material in such a manner that the amorphous metal is firmly bonded to the surface of the base material in the form of a coating layer. In the amorphous-metal-coated structure manufactured by this method, the amorphous metal and the metal constituting the base material are forced to protrude into each other at the bonding interface, and thereby the amorphous metal coating layer is firmly bonded to the base material by means of the metallic binding force. The amorphous metal-coated article may be employed as a member for a torque sensor.

9 Claims, 15 Drawing Figures

FIG. 7

| NO | COMPOSITION | MAGETO STUCTION CHARACTERISTIC ($\lambda S$) |
|---|---|---|
| 1 | $Fe_{75}B_{15}Si_{10}$ | $32 \times 10^{-6}$ |
| 2 | $Fe_{76}B_{8}Si_{16}$ | $36 \times 10^{-6}$ |
| 3 | $Fe_{76}B_{9}Si_{15}$ | $35 \times 10^{-6}$ |
| 4 | $Fe_{65}Co_{11}Si_{16}$ | $28 \times 10^{-6}$ |
| 5 | $Fe_{76}B_{8}Si_{10}Cr_{6}$ | $32 \times 10^{-6}$ |
| 6 | $Fe_{75}B_{9}Si_{12}Cr_{3}$ | $33 \times 10^{-6}$ |
| 7 | $Fe_{72}B_{20}Si_{15}Cr_{3}$ | $31 \times 10^{-6}$ |
| 8 | $Fe_{70}B_{9}Si_{14}Cr_{5}Mo_{2}$ | $28 \times 10^{-6}$ |
| SAMPLE FOR COMPARISON | Ni PLATING (10$\mu$ IN THICKNESS) | $20 \times 10^{-6}$ |

FIG. 9

| | COMPOSITION | MAGNETIC PROPERTIES | | | VICKERS HARDNESS HV |
|---|---|---|---|---|---|
| | | SATUNATION MAGNETIC RLUX DENSITY Bs | PERMEABILITY $\mu e$ | COERCIVE FORCE Hc | |
| 1 | $Fe_{70}Co_{15}B_{15}$ | 14.7 | $8 \times 10^3$ | 0.05 | 1030 |
| 2 | $Fe_{80}B_{15}Si_{15}$ | 15.2 | $9 \times 10^3$ | 0.03 | 910 |
| 3 | $Fe_{40}Ni_{40}P_{14}B_6$ | 6.5 | $3 \times 10^3$ | 0.03 | 790 |
| 4 | $Co_{80}B_{15}Si_5$ | 10.5 | $1.5 \times 10$ | 0.03 | 900 |
| 5 | $Ni_{78}B_{12}Si_{10}$ | — | — | — | 890 |
| SAMPLE FOR COMPARISON 1 | $Ni_{82}B_{18}$ | 6.8 | — | — | 450 |
| SAMPLE FOR COMPARISON 2 | $Ni_{95}P_5$ | 6.9 | — | — | 420 |

METHOD OF MANUFACTURING AN AMORPHOUS-METAL-COATED STRUCTURE

This is a continuation of application Ser. No. 711,486, filed Mar. 13, 1985, which was abandoned upon the filing hereof.

BACKGROUND OF THE INVENTION

1. Field of the Invention

The present invention relates to an amorphous-metal-coated structure in which, as a coating layer, an amorphous metal is formed on the surface of a base structure, and a method of producing same.

Since amorphous metal has a noncrystalline structure, it possess great mechanical strength and a small thermal expansion coefficient and is small in damage caused by radiation as well as being excellent in both chemical corrosion resistance and wear resistance. When employed for magnetic structure, amorphous metal further exhibits the following excellent properties: no structural defects in contrast to crystal structure having defect such as crystal grain boundaries; no crystal magnetic anisotropy; remarkably improved coercive force and specific magnetic permeability; and a high electrical resistivity. With the above-described various advantages, amorphous metal is known as "dream materials" and is expected to be applied to an extremely wide range of use, such as electromagnetic cores, various kinds of sensor, and electromagnetic clutches. An amorphous-metal-coated structure according to the present invention may be applied to various kinds of mechanical and electrical element, such as a magnetic member of, for example, a torque sensor, a magnetic head, a wear-resistant slide member, a corrosion-resistant filtering medium, and an electrode material for caustic soda electrolysis or a fuel cell.

2. Description of the Prior Art

As described above, amorphous metals have great mechanical strength and a small thermal expansion coefficient, and are excellent in both chemical corrosion resistance and wear resistance and therefore have been applied to various kinds of mechanical and electrical element. Further, amorphous metals have been used as magnetic materials for a variety of products by making use of their magnetic properties. For example, an amorphous metal has been used as a magnetostrictive material for a torque sensor (a sensor in which a magnetostrictive material is bonded to the surface of a drive shaft, and a change in magnetic characteristics of the magnetostrictive material which change is caused by the stress acting on the drive shaft is measured to thereby detect a degree of torque).

To bond an amorphous metal formed in a thin strip onto the surface of a drive shaft, methods employing an organic adhesive (an epoxy resin) or soldering have heretofore been used, such as that disclosed in the specification of Japanese Laid-Open Patent Publication No. 211030/1982 (U.S. Pat. No. 4,414,855, filed on June 1, 1981).

These methods, however, suffer the following problems. Since the joint between the drive shaft and the amorphous metal thin strip is unfavorably weak in its bonding strength, the amorphous metal thin strip is apt to separate from the drive shaft due to fatigue as a result of its use over a long period of time, or variation of the magnetic characteristics in response to applied stress is apt not to take place sufficiently.

Japanese Laid-Open Patent Publication No. 9034/1983 also discloses a torque sensor employing an amorphous metal thin strip as a magnetostrictive material which is bonded to the surface of a drive shaft. In the Publication No. 9034/1983, however, no practical method of bonding the amorphous metal thin strip is disclosed.

There is still another bonding method in which a magnetic material for a torque sensor is welded to a drive shaft by means of plating, such as that disclosed in the Japanese Laid-Open Patent Publication No. 101192/1973 (U.S. Pat. No. 3,861,206). By this method, however, it is not possible for the amorphous metal to be sufficiently firmly bonded to a base material.

Thus, in the above-described conventional bonding methods, it has been impossible for amorphous metals to exert their full beneficial properties.

SUMMARY OF THE INVENTION

In view of the above-described facts, it is a primary object of the present invention to provide an amorphous-metal-coated structure in which, as a coating layer, an amorphous metal is firmly secured to the surface of the base material of the structure, and to provide a method of producing same.

To this end, according to the invention, there is provided a method of manufacturing an amorphous-metal-coated structure which comprises the steps of: disposing an amorphous metal powder or an amorphous metal thin strip or a combination of a bonding powder and an amorphous metal thin strip on the surface of a base material on which a coating layer is to be formed; and subjecting the base material and the amorphous metal to a high energy rate working treatment in such a manner that the amorphous metal is firmly bonded to the surface of the base material so as to form a coating layer.

The following is an explanation of matters which must be particularly taken into consideration when forming an amorphous metal-coated article.

In general, the interior of a base material is not uniform due to various causes, such as internal stress, crystal grain boundaries, segregation of components, lattice defects and precipitation of impurities. For this reason, the value of magnetic permeability of the base material varies one-by-one with respect to both different portions and different directions. Accordingly, when an amorphous metal is simply disposed on the surface of the base material and both are subjected to a high energy rate working treatment in such a manner as to bond them together, such problems as lattice defects, the crystal grain boundary, the component non-homogeneity and impurity precipitation are caused between amorphous metal powder particles themselves and between the respective atoms of the powder and the base material. These problems become reasons for insufficient bonding between them.

Thus, according to the present invention, formation of an amorphous-metal-coated structure is carried out while paying attention to the following points.

The first point to be taken into consideration prior to the high energy rate working treatment of the amorphous metal and the base material is that the amorphous metal powder and/or its thin strip should be produced in an inert gas atmosphere of argon (Ar). This is done for the purpose of preventing any oxide layer from being formed on the amorphous metal powder surface and/or the thin strip surface. Secondly, the particle diameter of the amorphous metal powder should be 0.01

μm to 200 μm. On the other hand, in a case where bonding powder is used between amorphous metal strip and base material, the particle diameter of the bonding powder should be 0.02 μm to 200 μm. These ranges of particle sizes are preferred to effect good bonding between the amorphous metal powder and/or the amorphous metal thin strip and the base material together at the time of the high energy rate working treatment. Thirdly, the surface of the base material on which a coating layer is to be secured and the surface of the amorphous metal powder or the thin strip should be subjected to a plasma treatment in an atmosphere of hydrogen of $10^{-2}$ to 10 Torr in pressure. Such plasma treatment is effective in removing any oxide layer from the above-described surfaces and activating the same for the purpose of improving the bonding between the amorphous metal and the base material at the time of the high energy rate working treatment.

Fourthly, a method by which the energy emitted per unit of time is uniformly applied to both the base material and the amorphous metal should be employed at the time of the high energy rate working treatment. The employment of such method permits the amorphous metal powder particles to be uniformly bonded together and also allows the amorphous metal powder and/or thin strip and the surface of the base material to be uniformly bonded together throughout the bonding interface therebetween. Fifthly, there should be carried out in an inert gas atmosphere a heat treatment for removing any strain at the boundary between the base material and the amorphous metal or any strain in amorphous metal grains itself, these strains being caused by the application of high energy after the high energy rate working treatment. In addition, the heat treatment should be carried out within a temperature range in which the amorphous metal, which is noncrystalline, is not crystallized.

By paying attention to the above-described points, it is possible, according to the present invention, to form an amorphous-metal-coated structure in which an amorphous metal is firmly secured to the surface of a base material.

The above and other objects, features and advantages of the present invention will become clear from the following description of the preferred embodiments thereof, taken in conjunction with the accompanying drawings.

BRIEF DESCRIPTION OF THE DRAWINGS

FIG. 7 is a table showing compositions of amorphous metal powders and their respective magnetostrictive characteristics measured after being formed into coating layers;

FIG. 9 is a table showing the respective compositions, Vickers hardness values and magnetic properties of the amorphous-metal-coated articles embodying the present invention;

DESCRIPTION OF THE PREFERRED EMBODIMENTS

Figure 1:
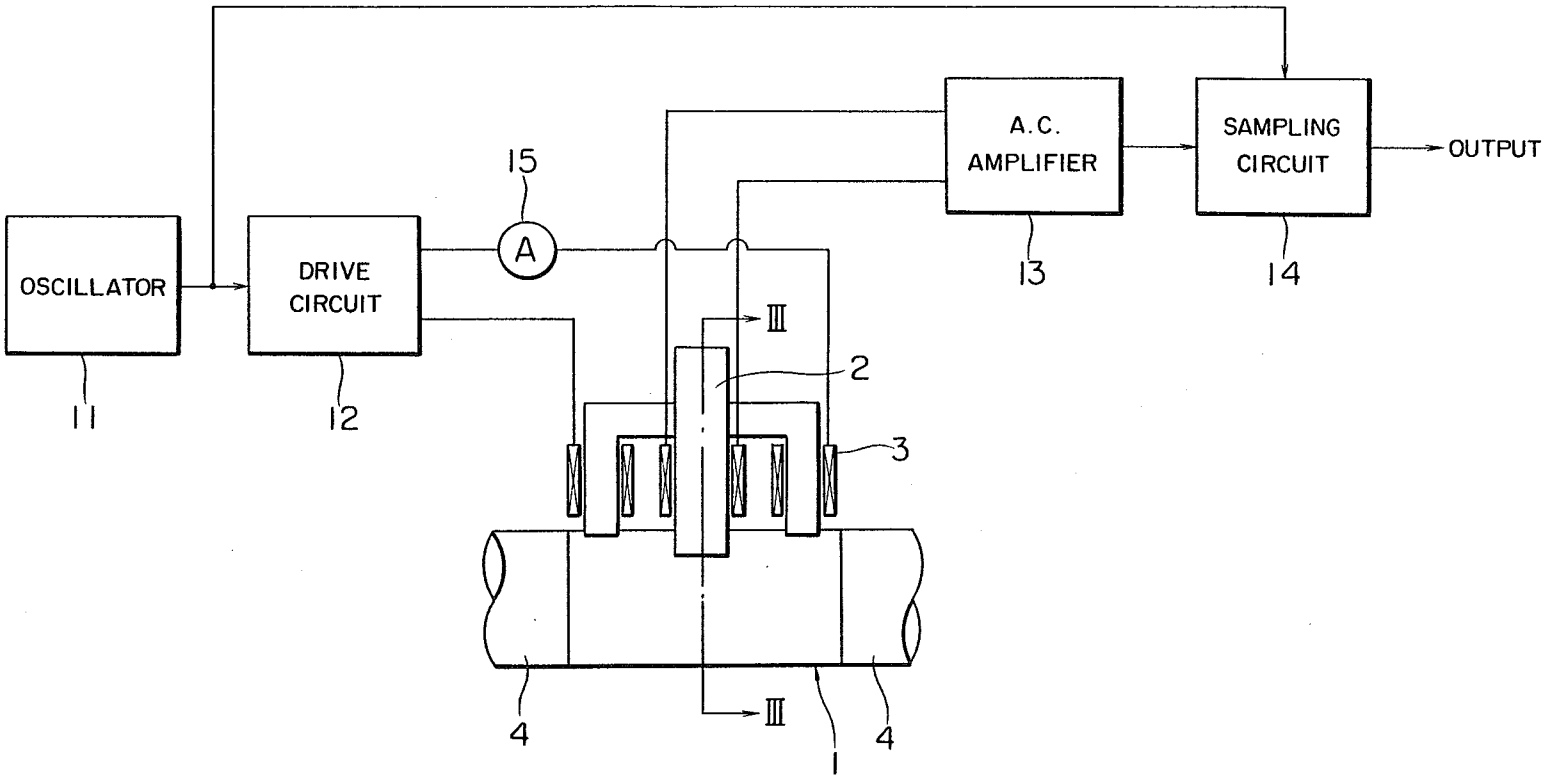
FIG. 1 schematically shows a torque sensor of a drive shaft comprising the amorphous-metal-coated structure embodying the present invention.

The present invention will be described hereinunder in detail in two sections, that is, firstly, as it applies in the case where an amorphous metal in the form of powder is used (a first embodiment) and secondly, as it applies in the case where an amorphous metal in the form of a thin strip is used (second and third embodiments).

FIRST EMBODIMENT

First of all, the invention will be described through one embodiment in which an amorphous metal is employed in the form of powder.

The amorphous metal powder in this case has as its main body at least one selected from the group consisting of iron (Fe), cobalt (Co), nickel (Ni) and chromium (Cr), which are metallic elements, and silicon (Si). As the amorphous metal powder, it is also possible to employ an alloy of both a metallic element and a semimetallic element (e.g., phosphorus (P), carbon (C), boron (B) or silicon (Si), or an alloy of a ferrous element and a rare earth metal (e.g., Gd, Tb or Dy). Typical amorphous metal powders include $Fe_{70}Co_{15}B_{15}$, $Fe_{80}B_{15}Bi_5$, $F_{40}Ni_{40}P_{14}B_6$, $Fe_{70}Co_{15}B_{15}$, $Co_{80}B_{15}C_{15}$ and $Ni_{78}B_2Si_{10}$ (where numerical values, such as 70, 15 and 5 represent atomic percentages). The particle configuration of the amorphous metal powder employed is preferably a spherical shape having an excellent symmetry or an elongated gourd-like shape. When occasion demands, however, the particle of a thin leaf-like shape or a ribbon-like shape or a linear shape may be used.

According to the present invention, an amorphous metal powder is employed whose particle diameter is in the order of 0.01 μm to 200 μm. The reason for limiting the particle diameter within such a range is as follows. In an amorphous metal powder having a particle diameter less than 0.01 μm, the volume of each of the powder particles becomes small as compared with its surface area. In consequence, the heat generated at the surface of each of the particles of the amorphous metal powder when it is subjected to a high energy rate working treatment, such as the explosive working treatment, is not sufficiently absorbed by the interior of the particle. As a result, the amorphous properties of the amorphous metal micronized powder are apt to be lost regarding the surface of the particle. On the other hand, in an amorphous metal powder having a particle diameter in excess of 200 μm, a low powder charge density is caused, which leads to a deterioration in the bonding of the powder particles.

It is possible to produce an amorphous metal powder having a particle size of 0.01 μm to 200 μm by employing an usual conventional method, for example, a revolving roll method, an atomization method, a spray method, a spark method or a cavitation method. On the other hand, it is possible to produce an amorphous metal powder of spherical particle shape by employing the spark method or the atomization method.

A representative example of producing an amorphous metal powder by the use of an in-rotatingliquid spray process will be explained hereinunder more specifically. A powder with a particle diameter of 1 μm to 1,000 μm which has a composition consisting of 65 parts of Fe, 15 parts of Co, 15 parts of B and 5 parts of Si is mixed in a ball mill and is then melted at a temperature not lower than 1,400° C. by high-frequency heating of 13.56 MHz. Thereafter, this molten metal is formed into the shape of a bar having a diameter of 5 mm to 30 mm. This bar-shaped molded piece is melted on heating at a temperature of 1,350° C. to 1,400° C. in a container of quartz or ceramics. This melting is preferably effected by high-frequency heating. Then, the molten metal thus obtained is jetted out from a nozzle of the container toward a liquid layer in a container-like rotary device, whereby the molten metal is pulverized at the liquid surface while being quenched at a rate of $10^{4°}$ to $10^{6°}$C./sec.

Figure 12:
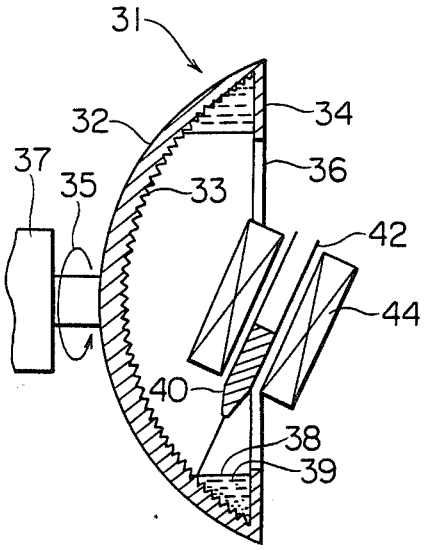
FIG. 12 is a sectional view of a container-like rotary device employed to produce an amorphous metal powder.

FIG. 12 is a sectional view of a container-like rotary device 31 which may be employed to produce the amorphous metal powder. In FIG. 12: the reference numeral 37 denotes a motor; 42 a nozzle for jetting out the molten metal; and 44 a high-frequency power source for heating. The rotary body device 31 is rotated at high speed in such a manner that a liquid layer is formed inside the rotary device 31 by the action of the centrifugal force and the molten metal is jetted out toward the surface of the liquid layer.

The container-like rotary device 31 is constituted by a rotary body having a rotating shaft 35 which defines the axis of rotation. The rotary device 31 has an opening portion 36 which is sealed at its periphery by a seal member 34. The rotary device 31 further has a window formed in the center of the opening portion 36. The container-like rotary device 31 has a wall 32 which has such a shape that the radius r of gyration gradually decreases as it comes away from the opening portion 36 along the rotating shaft 35. Specifically, the shape of the wall 32 is a quadratic surface, such as a paraboloid of revolution or a spherical surface. The inner surface 33 of the wall 32 is machined in a finely rugged shape. The difference in height between the crest and valley portions of the ruggedness is preferably selected to fall between 0.3 mm and 3 mm, and the pitch thereof is preferably within a range from 0.2 mm to 3 mm. Such rugged shape is effective in increasing the cooling speed of the molten metal when it is jetted out from the nozzle 42. The molten metal jetted out from the nozzle 42 is partially reflected by the liquid surface in such a manner as to be scattered. The scattered molten metal comes in contact with the inner surface 33 of the wall 32 a multiplicity of times, with the result that the molten metal is pulverized and rapidly cooled, whereby an amorphous metal powder constituted by uniform and spherical particles is formed.

As the cooling liquid, water or an oil may be employed. The container-like rotary body device 31 is rotated by the motor 37. The rotational speed of the rotary device 31 is preferably set such that the peripheral speed thereof at the point at which the molten metal is jetted out is 40 m/sec to 100 m/sec. By using these conditions, an amorphous metal powder whose particle diameter is 0.01 μm to 200 μm is produced. The production of the amorphous metal powder is preferably carried out in an atmosphere of argon (Ar) gas in order to prevent occurrence of any oxide layer on the surface of the powder.

The following is a more detailed description of the present invention in the case where the above-described amorphous metal powder is coated as a magnetic meterial for a torque sensor.

In this embodiment, the above-described powder is disposed on the surface of a drive shaft serving as a base material on which a coating layer is to be formed, and then, both are subjected to a high energy rate working treatment so as to bond them together, thereby forming an amorphous-metal-coated structure.

Figure 2:
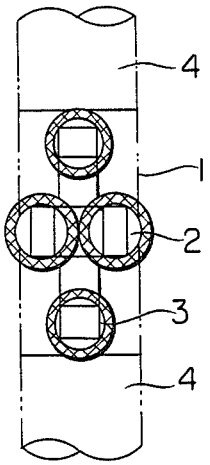
FIG. 2 is a drawing showing the positions of exciting coils of the torque sensor in FIG. 1.
Figure 3:
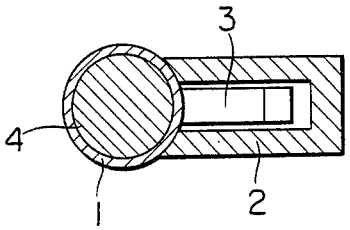
FIG. 3 is a sectional view taken along the line III—III of FIG. 1.
Figure 4:
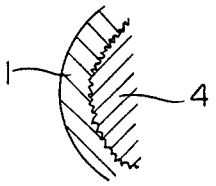
FIG. 4 is an enlarged schematic view of a bonding portion of amorphous metal and base structure of the drive shaft shown in FIG. 3.

FIG. 1 is a schematic view of a torque sensor in which the amorphous-metal-coated structure embodying the present invention is employed as its drive shaft; FIG. 2 shows the external appearance of an essential part of the torque sensor shown in FIG. 1, which particularly shows the position of exciting coils; FIG. 3 is a sectional view taken along the line III—III of FIG. 1; and FIG. 4 is an enlarged view of a portion of the torque sensor part shown in FIG. 3. As will be clear from FIG. 4, after the high energy rate working treatment has been effected, the amorphous metal powder is integrally bonded to the surface of the drive shaft in such a manner as to form a coating layer. The term "high energy rate working" means a working method in which energy is instantaneously emitted within an extremely short period of time (an extremely short time on the order of $10^{-3}$ to $10^{-6}$ second, in general) to thereby effect forming. Since the energy emitted per unit of time, that is, the energy rate, is extremely large, employment of a high energy rate working method makes it possible to firmly bond the amorphous metal powder to the surface of the drive shaft without generating a large amount of heat. Accordingly, it is possible to effect firm bonding without impairing the amorphous properties. The forming pressure applied by a high energy rate working treatment is preferably selected to be 0.7 GPa to 80 GPa. A forming pressure less than 0.7 GPa is so low that the powder particles cannot be bonded sufficiently and, therefore, it is hardly possible to effect integral forming. However, a forming pressure of 0.7 GPa or higher permits integral forming. More preferably, a forming pressure in excess of 1.5 GPa makes it possible to obtain a better and homogeneous coating material. A typical high energy rate working method is the explosive working method such as is shown in the Japanese Laid-Open Patent Publication No. 7433/1984. The explosive working method employs impact waves or the expansion of a gas generated by the explosion of TNT or dynamite in such a manner that pressure is instantaneously applied to an object. An explosive working treatment is generally carried out by exploding an explosive in water. The pressure applied by the explosive working treatment is adjusted by varying the following factors: the depth of the explosive below the water surface; the distance between the explosive and the object to be formed; and the amount of the explosive employed. The forming pressure in the case of the explosive working is also preferably 0.7 GPa to 80 GPa. Application of a pressure higher than 80 GPa results in generation of an excessively large amount of heat in bonding with the result that the amorphous metal is apt to become partially crystallized and consequently its amorphous properties is apt to be lost. On the other hand, in a case of a forming pressure lower than 0.7 GPa the amorphous metal particles are not sufficiently bonded. The above-described pressure range is obtained by a known measuring method such as that mentioned in "Solid State Physics", Vol. 6, edited by Seitz, F. & Turnbull, D., published by Academic Press, New York, 1958.

In practice, the above-described amorphous metal powder is subjected to an etching treatment to remove any oxide layer on the surface thereof for 10 to 30 minutes by means of a plasma of an output of 100 W to 200 W at 13.56 MHz in a reducing atmosphere of $10^{-2}$ to 10 Torr into which a gas containing 20% hydrogen and 80% argon is introduced at a rate of about 400 cc/min. The temperature in this case is made lower than the temperature (450° C.) at which the amorphous metal is crystallized. The temperature is preferably selected to fall between 250° C. and 450° C. By using these conditions, the surface of the amorphous metal powder is made free from any oxide layer and, at the same time, is activated. Further, the drive shaft having a diameter of 20 mm and a length of 250 mm is also activated by a similar treatment in a plasma. The drive shaft is preferably made of a material whose Vickers hardness is 100 Hv to 300 Hv. The material may be an iron- or nickel-base metal, such as JIS S45C, JIS S55C, AISI 416, AISI 304 or AISI 316. The reason for limiting the Vickers hardness range is described below. Namely, a Vickers hardness of 300 Hv or more undesirably prevents deformation of the surface of the base material and, therefore, it is difficult for the powder to enter the inside of the base material, resulting in an unfavorably low bonding strength. On the other hand, a Vickers hardness less than 100 Hv causes the base material to be undesirably deformed at the time of compression by explosion, which makes it impossible for the base material to maintain its shape.

Next, the drive shaft with a 20 mm diameter which has been subjected to the above-described treatment is disposed in the center of a cylindrical container which is made of a copper or iron-base material and has an inside diameter of 32 mm to 36 mm. Then, while a vibration (5 Hz to 100 Hz) is being applied to the space between the drive shaft and the cylindrical container, the space is filled with the amorphous metal powder, which had been subjected to the above-described treatment, in such a manner that the density of the powder is about 50% of the theoretical density and the thickness thereof is 6 mm to 8 mm. After being evacuated, the cylindrical container is sealed. Thereafter, a sheet explosive is exploded to previously bond together the amorphous metal powder and the drive shaft inside the container in such a manner that the density of the metal powder becomes 85% to 95% of the theoretical density and the thickness thereof becomes 4 mm to 5 mm. Then, the container is placed in the center of an explosive disposed inside a forming chamber, and an explosive working treatment is carried out. In this case, a spot explosion caused by a detonator becomes planar explosion waves by an explosive lens, which are then simultaneously propagated to the upper surface of a main explosive, thus causing the main explosive to explode. The amorphous metal powder in the cylindrical container is simultaneously compressed in both the radial and axial directions by the impact waves caused by the explosion. Thus, the amorphous metal powder is compressed by the impact waves which are applied thereto through the cylindrical container, whereby the powder particles are made to be firmly bonded to each other and the powder is reliably bonded to the surface of the drive shaft. The period of time during which the powder is affected by the impact action caused by the impact waves emanating from the explosion is on the order of $10^{-6}$ second. The pressure applied in this case is 0.7 GPa to 80 GPa.

The pressure which is applied to the amorphous metal powder by the impact action is controlled in a manner described below, depending on the particle size proportion of amorphous metal powders employed, as shown in FIG. 5.

Figure 5A:
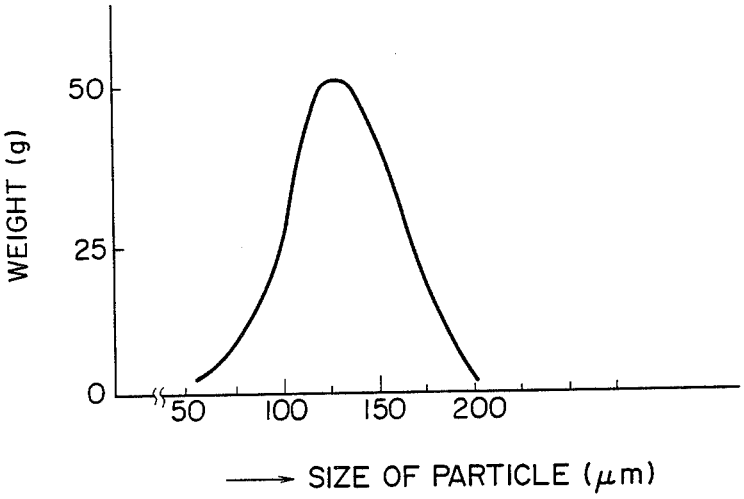
FIGS. 5A, 5B and 5C are graphs showing the particle size distribution proportion of amorphous metal powders.
Figure 5B:
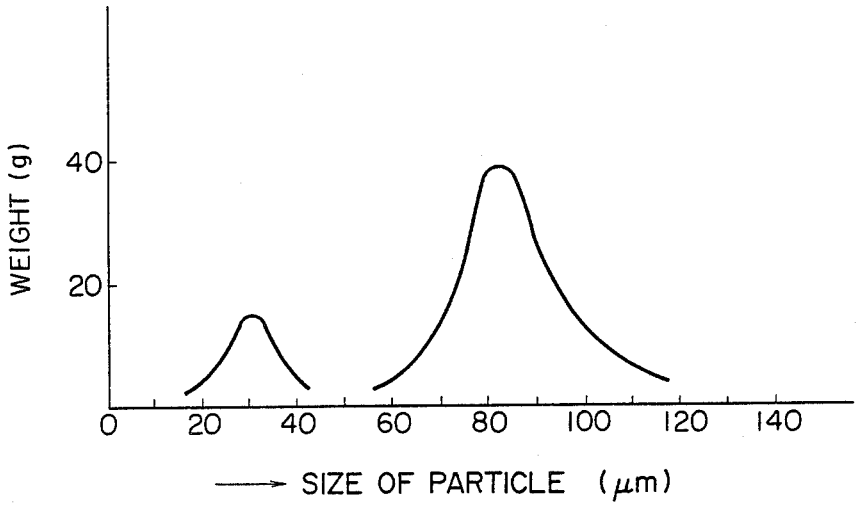
Figure 5C:
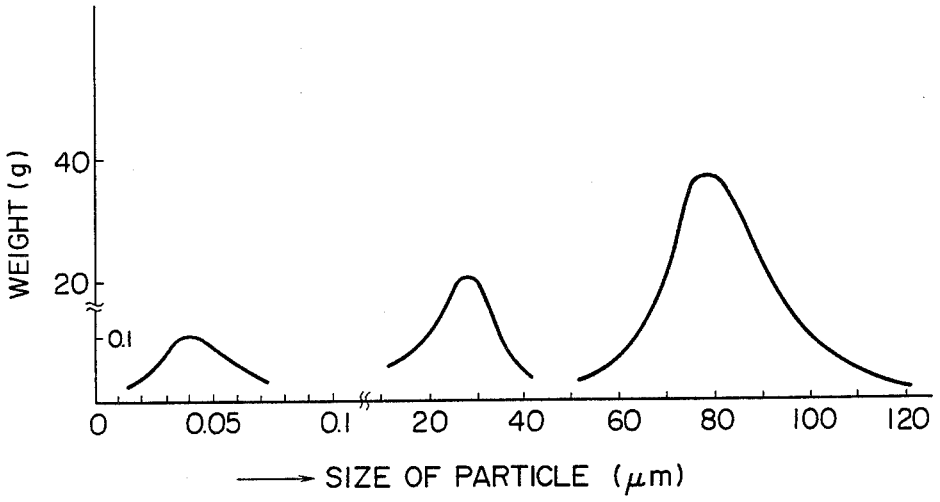

In the case of employing an amorphous metal powder whose particle size proportion is such as one shown in FIG. 5A, (that is, the case of employing 100 wt % of an amorphous metal powder having a particle size range from 50 μm to 200 μm, the center of which particle size distribution is at 125 μm), a pressure of about 10 GPa to about 80 GPa is applied. When the particle size proportion is such as one shown in FIG. 5B that is, an amorphous metal powder is employed which consists of 5 wt % to 20 wt % of a powder having a particle size range from 10 μm to 50 μm in which the center of the particle size distribution is at 30 μm and 80 wt % to 95 wt % of a powder having a particle size range from 50 μm to 130 μm in which the center of the particle size distribution is at 85 μm), a pressure of about 8 GPa to about 50 GPa is applied. Further, when the particle diameter proportion is such as one shown in FIG. 5C, (that is, an amorphous metal powder is employed which consists of 0.1 wt % to 0.5 wt % of a micronized powder having a particle size range from 0.01 μm to 0.08 μm in which the center of the particle size distribution is at 0.04 μm, 5 wt % to 30 wt % of a powder having a particle size range from 10 μm to 40 μm in which the center of the particle size distribution is at 30 μm and 55 wt % to 95 wt % of a powder having a particle size range from 50 μm to 130 μm in which the center of the particle size distribution is at 85 μm), a pressure of 0.7 GPa to 10 GPa is applied. By using these conditions, each of the above-described amorphous metal powders is bonded to the surface of the drive shaft at a density of 90% to 99.9% of the theoretical density, with a thickness of 2 mm to 3 mm and a width of 50 mm to 70 mm. However, the pressure applied by the explosion is preferably made relatively small in consideration of the possible deformation of the base material at the time of the explosive working treatment. For this reason, it is preferable to employ an amorphous metal powder having a particle diameter proportion such as that shown in FIG. 5C. In such case, the pressure is preferably selected to fall between 0.7 GPa and 10 GPa.

The lower limit of the range of explosion pressure is determined by the degree of pressure at which the boundary between powder particles disappears, while the upper limit thereof is determined by the degree of a pressure up to which the amorphous phase is maintained in spite of the heat generated at the time of the explosion. More specifically, at a pressure of 90 GPa or higher, the amorphous particles are heated by the heat generated between the powder particles at the time of the explosion, whereby the amorphous phase is undesirably changed into a crystalline phase which can no longer be returned to its previous amorphous phase even if it is quenched.

It is to be noted that the container of copper or an iron-base material which has been disposed on the outer periphery of the drive shaft is removed by means of grinding or cutting after the explosive working treatment. The drive shaft from which the container has been removed is heat-treated for about 1 to 2 hours while being exposed to a magnetic field (1,000 to 2,000 oersted) at a temperature (100° C. to 350° C.) at which the amorphous coating is not crystallized, whereby the magnetic properties are greatly improved.

Thus, an amorphous-metal-coated structure is formed such as that shown in FIG. 4 which illustrates a drive shaft 4 having an amorphous metal coating layer 1 firmly bonded to its surface. In this case, the amorphous metal coating layer 1 is a homogeneous layer in which the powder particles are excellently bonded to each other. The inside of the amorphous metal coating layer 1 includes hardly any boundaries between the powder particles or grain defects. Further, at the interface between the amorphous metal powder and the surface of the drive shaft serving as the base material, both the materials are forced to protrude into each other, thereby intensifying the bonding between them. The inspection of this amorphous metal coating layer by means of electron beam diffraction shows that the amorphous metal coating layer favorably presents a halo pattern and is amorphous in its entirety.

The following is a description of the operation of the torque sensor employing the thus formed amorphous-metal-coated structure as its magnetic material. As shown in FIG. 1, a coil 2 for exciting the coating layer and detection coils 3 for detecting the magnetostrictive characteristics of the coating layer are installed in the vicinity of the surface of the drive shaft 4 formed with the coating layer, whereby it is possible to measure an electromotive force resulting from the strain which is caused by a torque transmitted to the drive shaft 4. The electromotive force is amplified and is taken out as an electric signal. A detection circuit is arranged such that a signal output from an oscillator 11 is altered into a square wave in a drive circuit 12 which applies a current to the exciting coil 3. The electromotive force which is generated in the detection coils 2 by the strain caused by the driving torque is amplified by an AC amplifier 13 and is sampled by a sampling circuit 14 where it is compared with the exciting square wave, whereby the torque is detected.

A second embodiment of the present invention will be described hereinunder in which an amorphous metal in the form of a thin strip is employed.

SECOND EMBODIMENT

According to this embodiment, in place of the amorphous metal powder, an amorphous metal thin strip is employed to form an amorphous-metal-coated structure by means of a high energy rate working treatment.

Figure 6A:
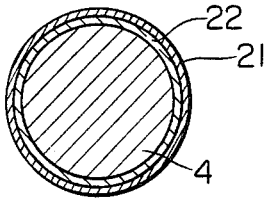
FIG. 6A is a sectional view of a drive shaft comprising another amorphous-metal-coated structure embodying the present invention.
Figure 6B:
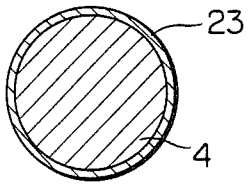
FIG. 6B is a sectional view of a drive shaft comprising a still another amorphous-metal-coated structure embodying the present invention.

FIG. 6A is a sectional view of a drive shaft showing the second embodiment. As shown in FIG. 6A, a bonding powder layer 22 which will be explained hereinunder is interposed between the drive shaft 4 and an amorphous metal thin strip 21. Thereafter, the explosive working treatment is carried out as a high energy rate forming treatment, whereby the following amorphous-metal-coated structure is formed. The other treatments and the explosive forming treatment are similar to those in the first embodiment.

The amorphous metal thin strip 21 has a composition similar to that of the amorphous metal powder in the first embodiment. The thin strip 21 has a thickness of 20 μm to 250 μm. The thin strip 21 is produced by a revolving roll method which is one of quench solidifying methods. More specifically, the molten metal having the above-described composition is jetted out onto the surface of a rotary member which has a diameter of 300 mm and is rotated at high speed (2,000 rpm to 6,000 rpm), whereby the metal is rapidly cooled so as to be solidified, thus producing a ribbon-shaped thin strip.

Regarding the bonding powder which is employed to form the bonding powder layer 22, it is possible to employ any powder, provided that it has the capability of bonding together the drive shaft 4 and the amorphous metal thin strip 31 by means of a high energy rate working treatment. This capability is attributable to the particle diameter of the powder and the activated state of the powder surface. Powders having such capability include amorphous metal powders, crystalline metal powders and ceramic powders, such as those explained in relation to the first embodiment. The crystalline metal powders include, for example, Fe, Cu, Si, Cr, Al and B. On the other hand, the ceramic powders include SiC, $Si_3N_4$, $ZrO_2$, $Al_2O_3$, $TiO_2$ and $SnO_2$. It is to be noted that, in addition to the above-described powders, any powder which has bonding capability may be employed.

The bonding powder employed to form the bonding powder layer 22 preferably has a particle size within a range from 0.02 μm to 200 μm. The reason for limiting the particle size within such a range is as follows. A powder having a particle size less than 0.02 μm is not easily produced and, at the same time, it is difficult to handle such a powder because of its excessively fine size.

Moreover, in a powder having a particle size less than 0.02 μm, the volume of each of the particles of the powder becomes small as compared with its surface area, with the result that the heat generated at the surface of the amorphous metal powder particle at the time of a high energy rate working treatment, such as an explosive working treatment, can not be sufficiently absorbed into the interior of the particle. As a result, the amorphous properties of the amorphous metal micronized powder which are present at the particle surface are apt to be lost. On the other hand, a powder having a particle size in excess of 200 μm causes a low powder charge density which leads to a deterioration in the bonding of the powder particles. It is to be noted that, if a bonding powder having a particle size not less than 30 μm is employed, then it is necessary to raise the pressure applied by a high energy rate working treatment, such as an explosive working treatment, to 50 GPa or higher. For example, when the particle size is 200 μm, it is necessary to apply a pressure of 70 GPa to 80 GPa. A pressure of 90 GPa or higher is, however, not preferable, since, at such a high pressure, the amorphous metal thin strip is undesirably crystallized by the action of high energy.

Accordingly, when a bonding powder having a particle size of 0.02 μm to 30 μm is employed in this embodiment, the pressure applied by an explosive working treatment as a high energy rate working treatment is preferably selected to fall between 10 GPa and 50 GPa. Further, the thickness of the bonding powder layer 22 interposed between the drive shaft 4 and the thin strip 21 needs to be at least three times as large as the particle size of the bonding powder. This is because the drive shaft 4 and the thin strip 21 are not sufficiently bonded together if there are only two or less powder particles in the bonding powder layer 22 in the direction of its thickness.

The amorphous-metal-coated structure formed as described above has a coating layer (95 μm to 105 μm in thickness) comprising the thin strip 21 (20 to 25 μm in thickness) constituted by a single thin strip and the bonding powder layer 22 (75 μm to 80 μm in thickness). The number of amorphous metal thin strip is not necessarily limited to one piece and a plurality of amorphous metal thin strips may be laminated one upon another according to what is required of the coating layer to be formed.

When the amorphous metal-coated article is required to possess magnetic properties, it is necessary for the amorphous metal thin strip to have a thickness not less than 10 μm. A thin strip thickness less than 10 μm causes extremely inferior magnetic properties. The thickness is preferably 50 μm or more.

When the amorphous-metal-coated structure is required to possess chemical corrosion resistance as well as wear resistance, it is necessary to employ an amorphous metal thin strip having a thickness of not less than 2 μm.

THIRD EMBODIMENT

In this embodiment, an amorphous metal thin strip (having the same composition as that of the second embodiment) is directly disposed on the surface of a drive shaft serving as a base material, and both are bonded together. In this case, it is necessary to apply an explosion pressure of 70 GPa to 80 GPa. An explosion pressure of 60 GPa or lower causes an inferior bonding between the amorphous metal thin strip and the base material and makes it impossible to obtain a stable bonding. More specifically, the amorphous metal thin strip has a Vickers hardness on the order of 800 Hv to 900 Hv and is therefore very hard. For this reason, the respective surfaces of the thin strip and the base material are not easily bonded together by the explosive working treatment. In this case, therefore, an explosion pressure of 70 GPa to 80 GPa is needed. On the other hand, a pressure in excess of 90 GPa is not preferable, since, at such a high pressure, the amorphous metal thin strip is undesirably crystallized during the explosive working treatment.

The working method employed in this embodiment is similar to those in the first and second embodiments. It is to be noted that the thickness of the coating layer of the amorphous-metal-coated structure obtained in accordance with this embodiment is 25 μm to 30 μm in the case of a single thin strip, 50 μm to 60 μm in the case of two thin strips, and 75 μm to 90 μm in the case of three thin strips. The explosion pressure in the third embodiment is preferably 70 GPa to 80 GPa irrespective of the number of thin strips. The number of thin strips may be increased, that is, to more than three, according to the thickness of the coating layer to be formed.

In the above-described embodiments, the drive shaft of the torque sensor which is a circular cylinder-shaped member is employed as the base material. The configuration of the base material is, however, not necessarily limited to such a circular cylinder shape. Any other shape may be employed, provided that it has a surface on which can be formed an amorphous metal coating layer. For example, the base material may have a prism shape, an elliptic cylinder shape or a flat plate shape. Further, the base material may have a complicated shape such as that of an electromagnetic clutch or a magnetic head. When a base material having any of the above-described shapes is subjected to a high energy rate working treatment, it is, as a matter of course, necessary to uniformly apply an impact pressure, in particular, to the surface of the base material.

Further, the amorphous metal employed in the first embodiment is in the form of powder and, therefore, it is possible to firmly bond the same to the surface of the base material even if the impact pressure at the time of high energy rate working treatment is relatively low (as compared with the other embodiments). Since it suffices to apply a relatively low pressure in this case, the base material on which a coating layer is to be formed is virtually not deformed at all. As a result, the amorphous-metal-coated structure formed has a high degree of dimensional accuracy.

The amorphous-metal-coated structure respectively formed in accordance with the first, second and third embodiments differ from each other in the thickness of their coating layers but have the same characteristics. For this reason, the measured values in relation to the amorphous-metal-coated structure which has been formed by the method shown in the description of the first embodiment will be mentioned hereinunder.

FIG. 7 is a table showing the relationship between the respective compositions of various amorphous metal powders and the magnetostrictive characteristics of coated structures respectively obtained by the use of the amorphous metal powders. As will be clear from the drawing, the amorphous-metal-coated structure according to the present invention are greatly improved in their magnetostrictive characteristics as compared with the sample for comparison (a conventional amorphous-metal-coated structure formed with a coating layer with a 10 μm thickness by Ni plating).

It is to be noted that the values in FIG. 7 were measured for coating layers, including those according to the invention, having a thickness of 10 μm and in a condition of 5 kθe (oersted).

Figure 8:
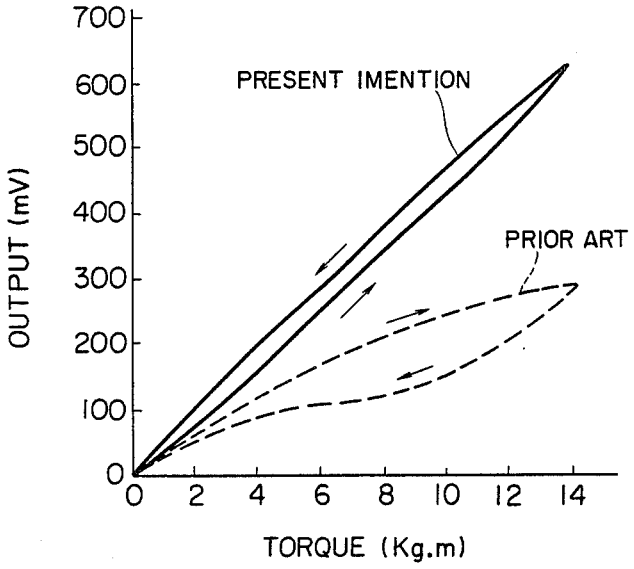
FIG. 8 is a graph showing the relationship between the torque and the output of the torque sensor in which the amorphous-metal-coated structure embodying the present invention is employed as its drive shaft.

FIG. 8 is a graph showing the relationship between the torque which is applied to the amorphous-metal-coated structure formed from the amorphous metal powder having the composition No. 2 ($Fe_{76}B_8Si_{16}$) in FIG. 7 and the output obtained from the amorphous metal coating layer. According to the graph, the torque which is applied to the amorphous-metal-coated structure serving as the drive shaft and the output obtained from the amorphous metal coating layer having a thickness of 20 μm as a result of the application of torque have an excellent proportional relation therebetween as compared with that of a conventional amorphous-metal-coated structure (Ni plating; 20 μm in thickness). The hysteresis difference resulting from the rising and lowering of the applied torque is also small as compared with the conventional amorphous metal-coated article (Ni plating; 20 μm in thickness). In addition, the sensitivity (the ratio between the torque and the output) is also satisfactorily excellent. Thus, the amorphous-metal-coated structure according to the present invention has improved magnetic properties.

Next, a comparison as made as to the bonding strength between the amorphous-metal-coated structure (No. 2 in FIG. 7) according to the present invention which includes an amorphous metal coating layer with a thickness of 25 μm to 30 μm and a conventional amorphous metal-coated article (in which an amorphous metal thin strip having a thickness of 25 μm to 30 μm is bonded to the drive shaft by an epoxy resin having a thickness of 5 μm to 15 μm). When a torque of 14 kg·m was applied to each of the drive shafts of the prior art and the present invention, the sensitivity of the amorphous metal coating layer of the prior art is deteriorated when it had been used about 100 times of the application of torque and consequently the output thereof is deteriorated. However, the above-described amorphous-metal-coated structure embodying the present invention experienced no change after being used 100,000 times of the application of torque and the output thereof did not decrease. It will be understood from the above that this amorphous-metal-coated structure embodying the present invention has satisfactory durability as compared with conventional ones.

Further, the amorphous-metal-coated structure Nos. 5 to 8 in FIG. 7 are also resistant to corrosion and therefore can be employed in a corrosive environment.

The following is a description of various properties of amorphous-metal-coated structure of the present invention and the prior art: the Vickers hardness and magnetic properties (FIG. 9) measured in relation to amorphous-metal-coated structure respectively formed by bonding various amorphous metal powders to the surface of a drive shaft (20 mm in diameter; material: S45C) serving as the base material, the powders having compositions which are different from that of the base material; the relationship between the thickness of coating layers and the Vickers hardness (FIG. 10); and the relationship between the thickness of coating layers and the separation load (FIG. 11).

FIG. 9 is a table showing the respective magnetic properties (saturation magnetic flux density, permeability and coercive force) and the Vickers hardness of amorphous-metal-coated structure embodying the present invention. The amorphous-metal-coated structure have thicknesses ranging from 100 μm to 500 μm. The reason for such variations in the thickness is that it is experimentally difficult to strictly control the thickness of each of the coating layers formed on the surface of the drive shaft. As will be clear from FIG. 10, the Vickers hardness is saturated when the thickness of a coating layer exceeds 100 μm. For this reason, there may be no problem if such amorphous-metal-coated structure of different thickness are employed as samples when making a comparison as to the Vickers hardness, provided that they have thicknesses of not less than 100 μm.

Figure 10:
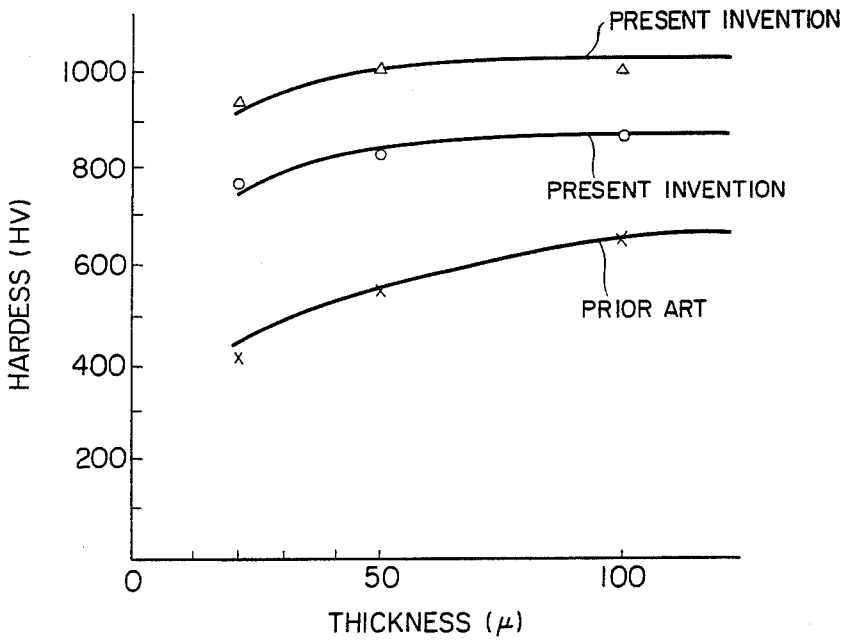
FIG. 10 is a graph showing the relationship between the thickness of the coating layer of the amorphous-metal-coated structure embodying the present invention and the Vickers hardness values thereof.

FIG. 10 is a graph showing the relationship between the thickness of coating layers and the Vickers hardness thereof. The marks o represent measured values in relation to a coated structure (composition: $Ni_{82}B_{18}$) embodying the present invention; the marks x represent measured values in relation to a conventional coated structure (by plating; composition: $Ni_{82}B_{18}$); and the marks Δ represent measured values in relation to another coated article embodying the present invention (composition: $Fe_{70}Co_{15}B_{15}$). The comparison made between the marks o (the present invention) and the marks x (the prior art) shows the fact that the present invention has a higher Vickers hardness than the prior art for any thickness. In other words, the amorphous-metal-coated structure of the present invention is harder than that of the prior art.

Figure 11:
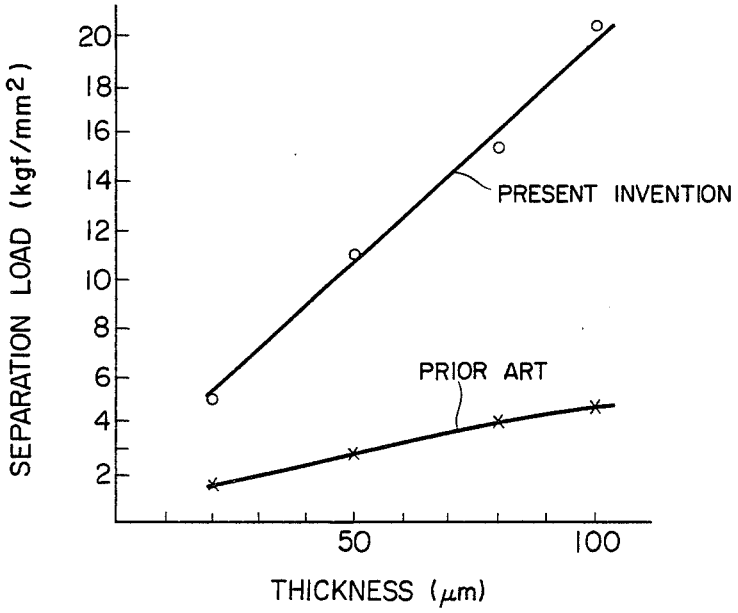
FIG. 11 is a graph showing the relationship between the thickness of the coating layer of the amorphous-metal-coated structure embodying the present invention and a exfoliating load for separating the amorphous metal coating from the base material.

FIG. 11 is a graph showing the relationship between the thickness of coating layers and the load at which each of the coating layers commences separating from the base material. The measurement was carried out as follows. Drive shafts respectively formed with coating layers were rotatably installed in the ambient air at 120° C., and various loads were imposed on the respective surfaces of the coating layers each through a plate material having a friction coefficient of 0.3 to 0.4. Under this state, the drive shafts were rotated for 30 minutes. Then, with respect to the drive shafts from which the coating layers had been separated, the minimum loads at which the coating layers became separated were plotted. The marks o represent measured values in relation to the amorphous-metal-coated structure (composition: $Ni_{82}B_{18}$) of the present invention, while the marks x represent measured values in relation to the amorphous metal-coated article (by plating; composition: $Fe_{70}Co_{15}B_{15}$) of the prior art. For example, when the thickness of the coating layers was 100 μm, the coating layer of the coated structure according to the present invention had not become separated when inspected after the drive shaft had been rotated for 30 minutes with a load of 21 kgf/mm$^2$ imposed thereon, whereas the coating layers (deposit layers) of all the coated structures of the prior art became separated when the drive shafts were rotated with a load of 3.7 kg/mm$^2$ or more imposed thereon. In other words, the amorphous-metal-coated structure of the present invention has the coating layer more firmly bonded to the surface of the drive shaft as compared with that of the prior art (by plating).

Moreover, the amorphous-metal-coated structure (composition: $Ni_{82}B_{18}$) of the present invention is improved in its chemical corrosion resistance by 5% to 10% as compared with the amorphous-metal-coated structure (by plating; composition: $Ni_{82}B_{18}$) of the prior art. This comparison was made as follows. Both the coated articles were respectively dipped in one-normal (1N) hydrochloric acid solutions for 48 hours, and thereafter, the weight of any oxide caused in these solutions was measured. This comparison showed that the weight of the oxide caused in the solution in which the coated structure of the present invention had been dipped was smaller 5% to 10% than that of the prior art. This fact represents the above-described improvement in the chemical corrosion resistance of the coated structure of the present invention.

As has been described above, the present invention advantageously makes it possible to provide an amorphous-metal-coated structure in which an amorphous metal coating layer is firmly bonded to the surface of a base material by employing a high energy rate working treatment. Further, the amorphous-metal-coated structure having the amorphous metal coating layer thus firmly bonded to it satisfactorily exhibits various advantageous properties characteristics of the amorphous metal (e.g., magnetic properties, hardness, wear resistance and chemical corrosion resistance). When the amorphous-metal-coated structure according to the present invention is employed as, for example, a magnetostrictive material for a torque sensor, its magnetic properties are improved as compared with those of conventional magnetostrictive materials.

Further, the present invention makes it possible for an amorphous metal also to be bonded to the surface of any base material which is not composed of amorphous metals and therefore is economically advantageous. In other words, since unit costs of amorphous metals are extremely high compared with those of ordinary metals (about 5 to 100 times), employment of an amorphous metal for the surface of a structure alone advantageously permits a reduction in the product cost.

What is claimed is:

1. A method of manufacturing an amorphous-metal-coated structure having a columnar base portion and an amorphous metal coating layer provided on the base portion, said method comprising the steps of:

providing the base portion of 100 to 300 in Vickers hardness made of a crystalline alloy selected from the group consisting of a Fe-based alloy and a Ni-based alloy;

providing an amorphous metal powder for the coating layer, having a particle size of 0.01 to 200 μm;

providing a cylindrical container made of a metal; placing the columnar base portion at the center of the cylindrical container; filling a space defined between the cylindrical container and the columnar base with amorphous metal powder; and applying a pressure of 0.7 to 80 GPa on the powder from outer circumference of the container by use of a high energy rate working treatment so that the coating layer is formed and is firmly bonded to the surface of the base portion.

2. A method of manufacturing an amorphous-metal-coated structure according to claim 1, wherein said high energy rate working treatment is an explosive working treatment.

3. A method of manfaucturing an amorphous-metal-coated structure according to claim 1, wherein said amorphous metal powder is a mixture which consists essentially of 0.1 wt % to 0.5 wt % of a powder having a particle size within a range from 0.01 μm to 0.08 μm in which the center of the particle size distribution of said powder is at 0.04 μm, 5 wt % to 30 wt % of a powder having a particle size within a range from 50 μm to 130 μm in which the center of the particle size distribution of said powder is at 85 μm and wherein a pressure selected to fall between 0.7 GPa and 10 GPa is applied on said amorphous metal powder in order to firmly bond it to the surface of the base portion.

4. A method of manufacturing an amorphous-metal-coated structure according to claim 1, wherein said amorphous metal powder is a mixture which consists essentially of 5 wt % to 20 wt % of a powder having a particle size within a range from 10 μm and to 50 μm to 130 μm in which the center of the particle size distribution of said powder is at 85 μm and wherein a pressure selected to fall between 8 GPa and 50 GPa is applied on said amorphous metal powder is order to firmly bond it to the surface of the base portion.

5. A method of manufacturing an amorphous-metal-coated structure according to claim 1, wherein said amorphous metal powder consists essentially of 100 wt % of a powder having a particle size within a range from 50 μm in which the center of the particle size distribution of said powder is at 125 μm and wherein a pressure selected to fall between 10 GPA and 80 GPa is applied on said amorphous metal power in order to firmly bond it to the surface of the base portion.

6. A method of manufacturing an amorphous-metal-coated structure having a base portion and an amorphous metal coating layer provided on the base portion, wherein said amorphous metal is in the form of an amorphous metal thin strip and wherein a bonding powder having a particle size of 0.02 μm to 200 μm in an activated state is interposed between said amorphous metal thin strip and said base portion and wherein the bonding powder is a crystalline metal powder or a ceramic powder and pressure selected to fall between 10 GPa and 80 GPa is applied by use of a high energy state working treatment on said amorphous metal thin strip in order to firmly bond it to the surface of the base portion.

7. A method of manfuacturing an amorphous-metal-coated structure according to claim 6, wherein said high energy rate working treatment is an explosive working treatment.

8. A method of manufacturing an amorphous-metal-coated structure having a base material and an amorphous metal coating layer in the form of an amorphous metal thin strip coating said base material, said method comprising a step of applying a high energy rate working treatment to both said base material and said amorphous metal disposed on the surface of said base material in such a manner that said amorphous metal is firmly bonded to the surface of said base material, thereby forming said coating layer.

9. A method of manufacturing an amorpohous-metal-coated structure according to claim 8, wherein said high energy rate working treatment is an explosive working treatment.

* * * * *